US005937595A

United States Patent [19]

Miller

[11] Patent Number: 5,937,595

[45] Date of Patent: Aug. 17, 1999

[54] WINDOW INSULATING AIR BAG

[76] Inventor: Matthew A. Miller, 1559 Bruce St., Neenah, Wis. 54956

[21] Appl. No.: 08/851,568

[22] Filed: May 5, 1997

[51] Int. Cl.[6] ..... E06B 3/274

[52] U.S. Cl. ..... 52/202; 52/2.11; 52/2.22; 52/2.25; 52/203

[58] Field of Search ..... 52/2.11, 2.14, 52/2.17, 2.19, 2.22, 2.25, 202, 203

[56] References Cited

U.S. PATENT DOCUMENTS

| | | | |
|---|---|---|---|
| 3,251,399 | 5/1966 | Grossman | 52/203 X |
| 3,332,177 | 7/1967 | Sepp | 52/2.19 |
| 3,911,630 | 10/1975 | Nally . | |
| 3,918,512 | 11/1975 | Kuneman . | |
| 4,040,210 | 8/1977 | Land . | |
| 4,098,035 | 7/1978 | Bessler . | |
| 4,255,907 | 3/1981 | Lightell . | |
| 4,255,908 | 3/1981 | Rosenberg | 52/2.12 |
| 4,262,045 | 4/1981 | Cheng et al. . | |
| 4,346,132 | 8/1982 | Cheng et al. . | |
| 4,510,986 | 4/1985 | Schwankl | 52/202 X |
| 4,544,587 | 10/1985 | Nesbitt | 52/202 X |
| 4,649,681 | 3/1987 | Eisele | 52/202 |
| 4,699,842 | 10/1987 | Jorgensen et al. | 52/202 X |
| 5,466,500 | 11/1995 | Pluim | 52/202 X |

FOREIGN PATENT DOCUMENTS

| | | | |
|---|---|---|---|
| 2044334 | 10/1980 | United Kingdom | 52/203 |

*Primary Examiner*—Carl D. Friedman
*Assistant Examiner*—Laura A. Callo
*Attorney, Agent, or Firm*—Chase & Yakimo, L.C.

[57] ABSTRACT

A window insulating air bag includes a bag body presenting a perimetrical seam therearound and an adhesive strip extending continuously around the seam to secure and seal the air bag to the interior frame of the window. The bag body is formed of first and second layers of elastic thin plastic film, with the first layer being thinner than the second layer. This relationship presents a ballooning layer upon bag inflation adapted to engage the window's casing but spaced apart from the interior surface of the window. Preferably, the second layer has an air valve formed therein for inflation of the bag. Alternatively, the air bag is used with a conventional storm window having a rigid self supporting sheet of glass adapted to be secured to a window's exterior frame with the flexible air bag as discussed above secured to the window's interior frame.

5 Claims, 4 Drawing Sheets

WINDOW INSULATING AIR BAG

FIELD OF THE INVENTION

This invention relates to a window insulating air bag which improves heating efficiency. More specifically, the air bag is secured to a window's interior frame to provide an insulating dead air space.

BACKGROUND OF THE INVENTION

To conserve energy and control heating costs, it has always been important to have a well insulated house. Windows are a major source of heating inefficiency. Accordingly, it is desirable to improve the seal around window openings, especially during cold winter months. Various methods which have been developed, such as the use of storm windows, can still be improved. For instance, multiple pane windows can be used but tend to be expensive. Also, balloon type bags inflated between the storm window and the window's exterior surface have been used. The edges of the air bags can engage the planar surface of the window's glass panes. This defeats the purpose of the air bag since heat is thereby allowed to transfer through the window. Also, in larger windows, these air bags collapse or buckle and do not adequately seal the window.

SUMMARY OF THE INVENTION

Accordingly, a primary object of the subject invention is to provide a window insulating air bag having a bag body securable to the interior frame of a window and formed of first and second layers of thin elastic plastic film, with the first layer being thinner than the second layer to present a ballooning portion adapted to engage the window's sash or casing.

Another object of the subject invention is to provide a window insulating air bag that reduces heat transfer through a window.

Another object of the subject invention is to provide an improved storm window having an air bag as described herein.

Yet another object of the subject invention is to provide a window insulating air bag that is easy to install and inexpensive to manufacture.

These objects are attained by providing a window insulating air bag comprising a bag body presenting a perimetrical seam with an adhesive strip extending continuously around the seam to secure the air bag to the interior frame of a window. The bag body is formed of first and second layers of elastic thin plastic film, with the first layer being thinner than the second layer and presenting a ballooning portion adapted to engage the window's casing and remain spaced apart from the window's interior surface. Preferably, the second layer has an air valve formed therein for inflation of the bag.

Alternatively, the above objects may be attained by providing an improved storm window having a rigid self-supporting sheet of glass adapted to be secured to a window's exterior frame and a flexible air bag as disclosed herein for use with the rigid sheet and adapted to be secured to the window's interior frame.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
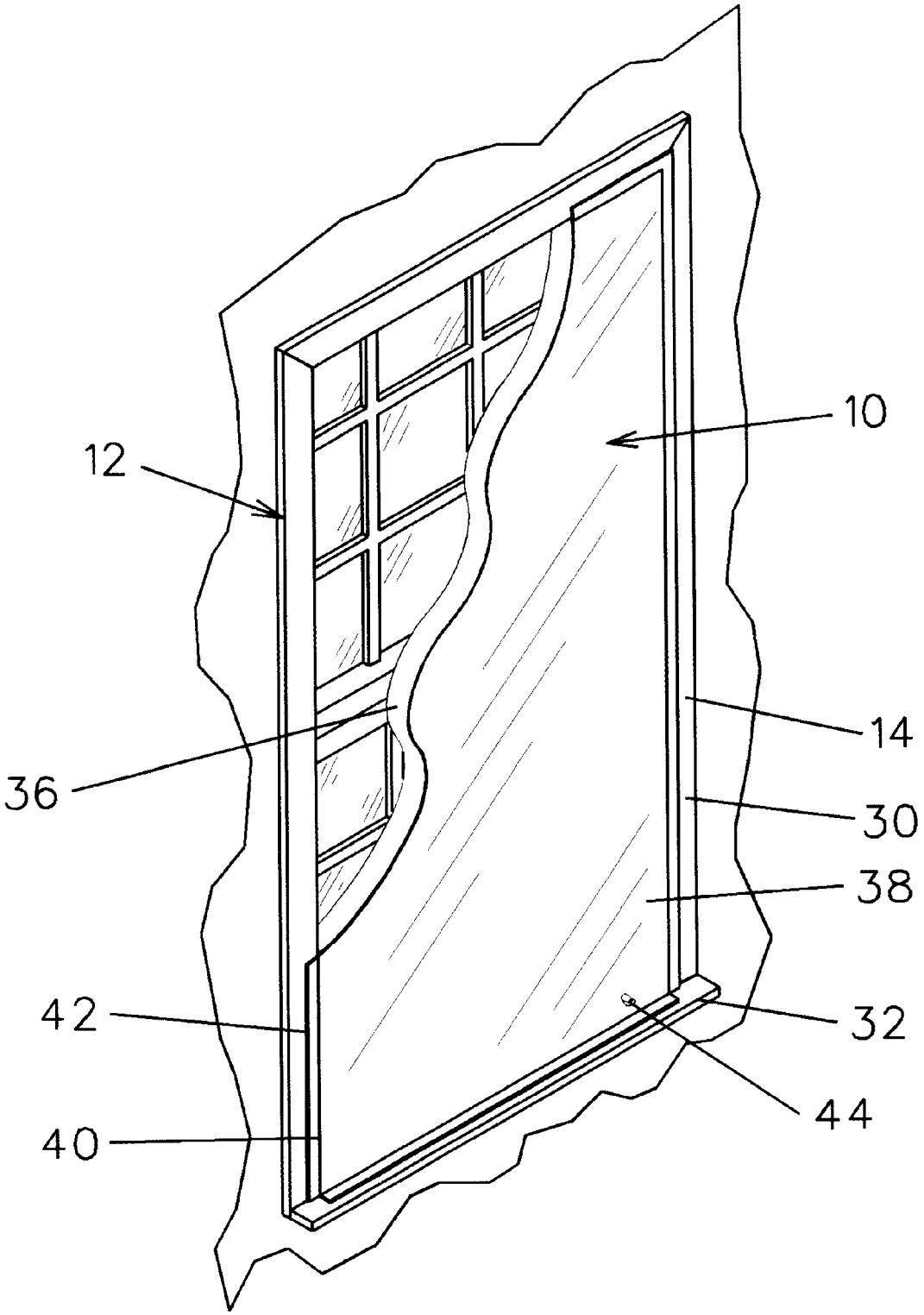
FIG. 1 is a perspective view of a window air bag in accordance with the present invention installed over a window's interior frame and broken away for clarity.
Figure 2:
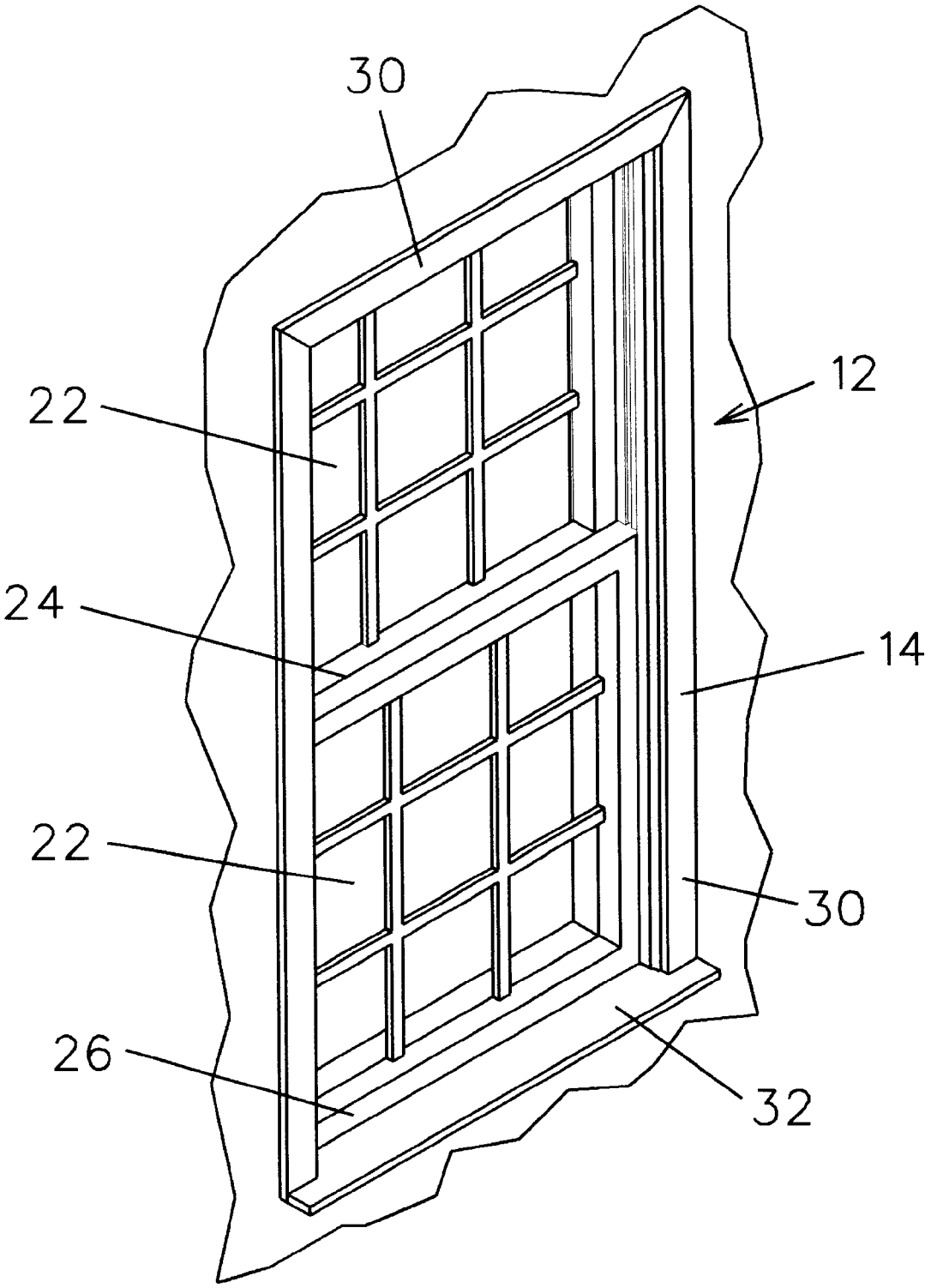
FIG. 2 is a perspective view of a conventional window showing the air bag's window mounting areas.
Figure 4:
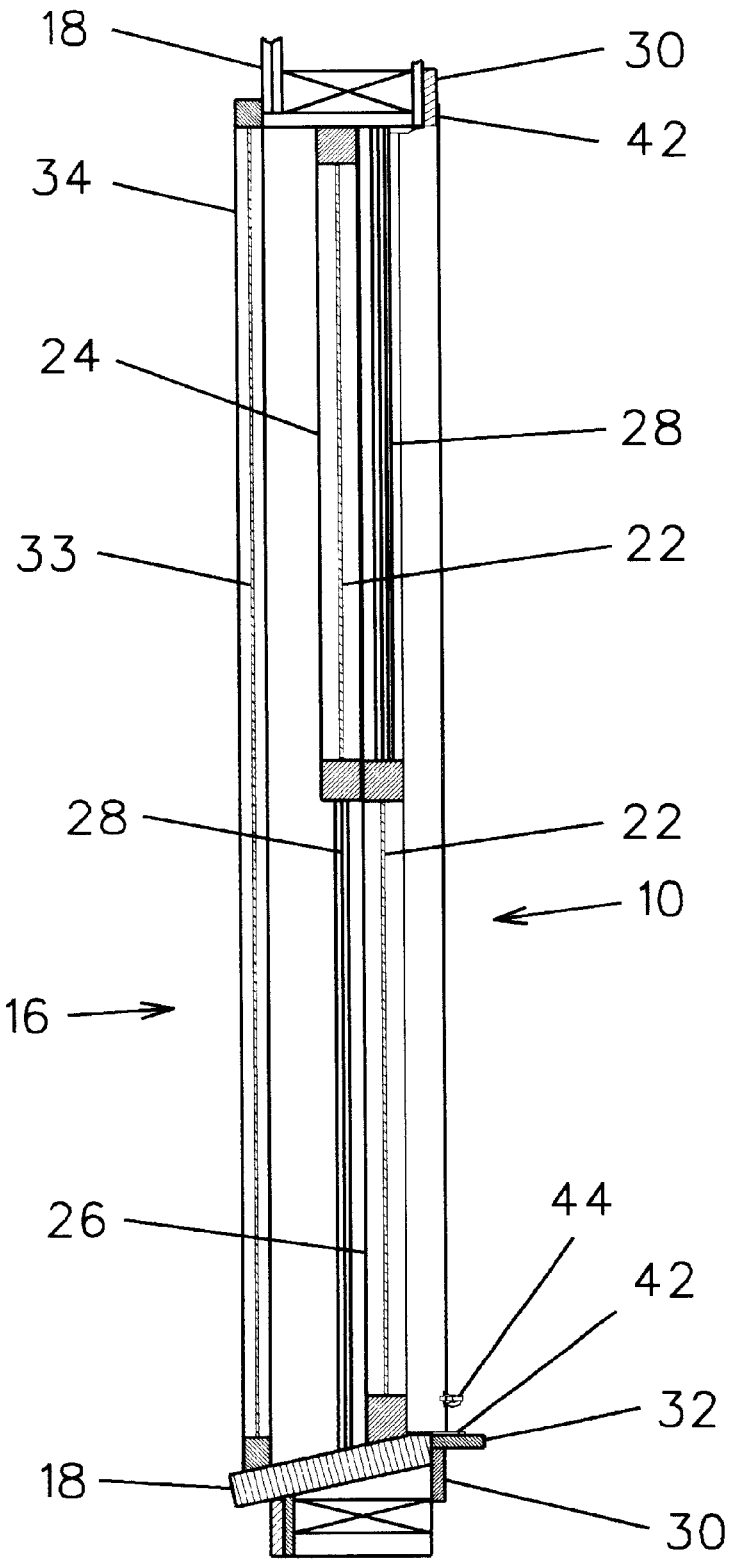
FIG. 4 is a lengthwise cross-sectional view of the window and air bag of FIG. 1.

An insulating air bag 10, as in FIG. 1, in accordance with the present invention, is securable to window 12 at its interior frame 14. Upon inflation, air bag 10 creates a dead air space to prevent the conduction of heat or cold therethrough and thereby improve heating efficiency. Air bag 10 is preferably used in connection with storm window 16 secured to the window's exterior frame 18, as in FIG. 4.

Window 12 is conventional and will only be described generally herein. Window 12 is formed of panes 22 mounted within upper and lower sashes or casings 24 and 26, respectively. Sashes 24 and 26 are mounted between longitudinally extending window guides 28 on each side thereof, as in FIG. 4. Window 10 is secured within a wall opening at interior and exterior frames 14 and 18. Interior frame 14 includes frame trim 30 and sill 32. Frame trim 30 extends perimetrically around window opening on the interior side thereof. Sill 32 extends outwardly from frame trim 30 along the bottom edge of the wall opening.

Storm window 16 is of a conventional type and includes a glass pane 33 mounted within casing 34. Casing 34 is secured to the window's exterior frame 18. See FIG. 4.

Figure 3:
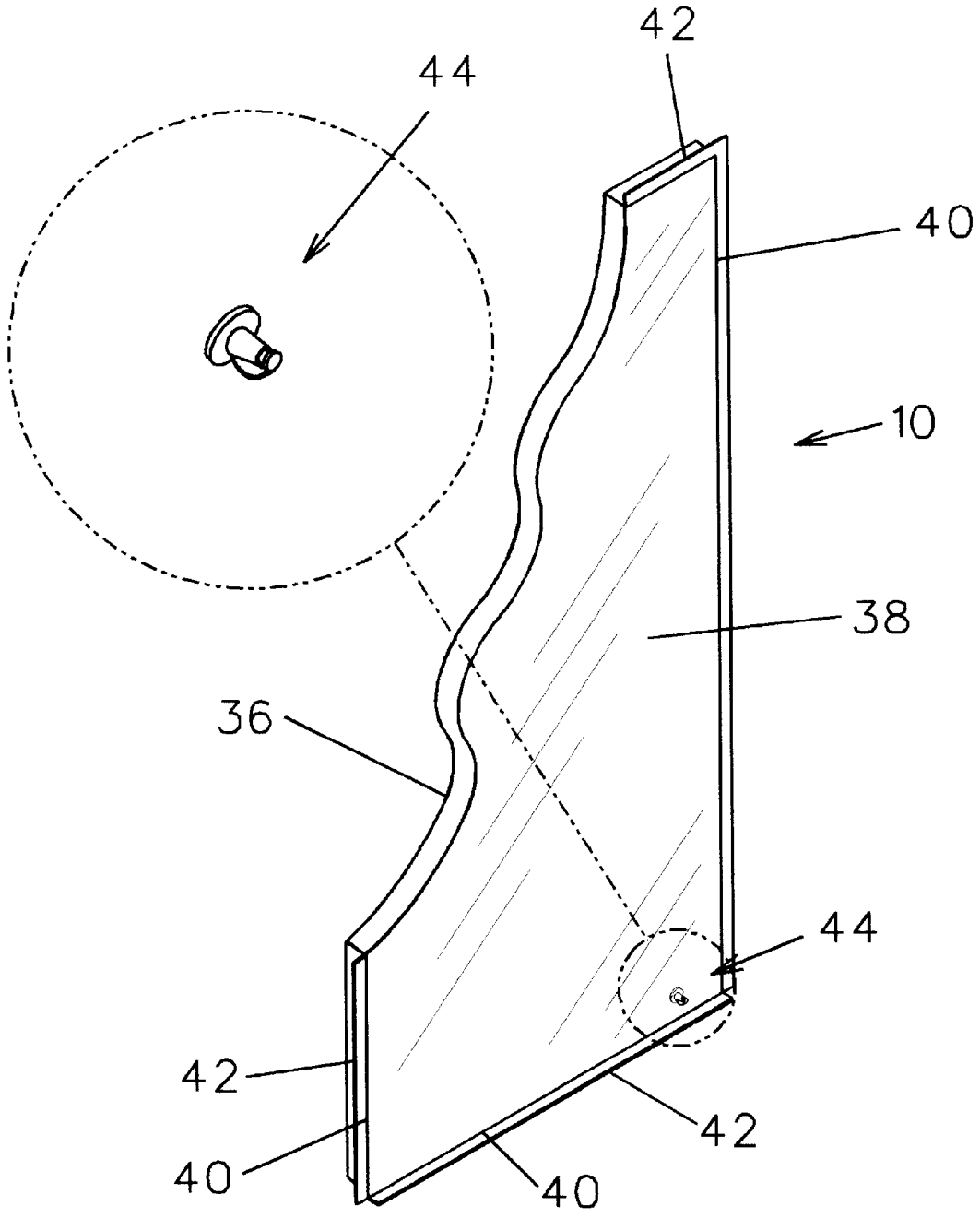
FIG. 3 is a perspective view of the window air bag of FIG. 1 with the air valve exploded for clarity.

Air bag 10 is formed of thin elastic plastic that presents first and second layers 36 and 38 joined at a perimetrical seam 40. See FIGS. 1 and 3. An adhesive strip or attachment member 42 extends outwardly from seam 40 preferably continuously therearound. Air bag 10 also includes an air valve 44 preferably formed in second layer 38 for easy manual inflation. First layer 36 is thinner/more flexible than second layer 38 and presents a ballooning portion. Layers 36 and 38 may be tinted for ultra-violet ray protection. Air valve 44 is conventional and similar to those found in air mattresses.

Adhesive strip 42 is preferably flexible to allow attachment to surfaces that extend at different angles from the wall opening. For instance, as in FIG. 1, adhesive strip 42 is attached to frame trim 30 which extends parallel to window 12 and sill 32 which extends perpendicular to window 12. Also, adhesive strip 42 should create a seal that helps to prevent air leakage. Preferably, adhesive strip 42 is not too wide but creates a border around interior frame 14. Adhesive strip 42 may be clear or colored to coordinate with interior frame 14. Adhesive strip 42 may also include a protective peelable backing strip to prevent exposure of adhesive strip 42 until air bag 10 is installed. Sealing adhesive used on strip 42 can take any form such as velcro, static adhesive or glue. Depending on the adhesive, air bag 10 may be reusable.

At installation, adhesive strip 42 is secured to interior window frame 14, as in FIG. 1. Air valve is easily opened for manual inflation of air bag 10. Upon inflation, the ballooning portion or first layer 36 of the bag 10 extends into and engages the sashes 24 and 26 around both upper and lower panes 22 but remains spaced apart from panes 22 to form a sealed dead air space which reduces conduction of heat and cold therethrough. Thus, the balloon effect of the bag does not extend into the room of the house. The thicker second layer 38 remains relatively flush with adhesive strip 42 and interior frame 14. These actions present a relatively flat, appealing appearance to the room interior while still performing the insulation function.

It is to be understood that while a certain form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. A storm window system for a window having a pane and exterior and interior frames, comprising:

a rigid self-supporting transparent sheet adapted to be secured to a window's exterior frame on one side of the window;

a flexible air bag for use with said sheet and adapted to be secured to an interior frame of the window;

said air bag formed of first and second flexible layers of material joined at a perimetrical seam, said first layer presenting a ballooning portion adapted to balloon inwardly from said second layer into a spaced relationship with a window pane;

a securing strip extending along said seam for securing said air bag to the window's interior frame and on an opposed side of the window.

2. A storm window system as claimed in claim 1 wherein said securing strip extends continuously around said perimetrical seam for sealing said air bag about the perimeter of the window's interior frame.

3. A storm window system as claimed in claim 1 wherein said bag's first layer is thinner than said second layer.

4. A storm window system as claimed in claim 3 wherein said second layer of said bag includes an air valve therein for introducing air therethrough for inflation of said bag.

5. A storm window system as claimed in claim 1 wherein said second layer is adapted to remain flush with said securing strip and the window's interior frame upon inflation of said bag.

* * * * *